United States Patent [19]

Cornelius et al.

[11] 4,289,411

[45] Sep. 15, 1981

[54] MULTILINGUAL INK JET PRINTER

[75] Inventors: Rorger W. Cornelius; James D. Hill; Paul A. Quinn, Jr., all of Lexington, Ky.

[73] Assignee: International Business Machines Corporation, Armonk, N.Y.

[21] Appl. No.: 92,601

[22] Filed: Nov. 8, 1979

[51] Int. Cl.[3] ..... B41J 3/04

[52] U.S. Cl. ..... 400/126; 400/111; 400/323.1

[58] Field of Search ..... 400/126, 109–111, 400/323, 323.1, 322, 328; 346/75

[56] References Cited

U.S. PATENT DOCUMENTS

| | | | |
|---|---|---|---|
| 3,964,591 | 6/1976 | Hill et al. | 400/126 |
| 3,970,183 | 7/1976 | Robinson et al. | 400/323 X |
| 4,150,902 | 4/1979 | Brescia | 400/126 X |
| 4,152,083 | 5/1979 | Kostoff | 400/328 X |
| 4,180,703 | 12/1979 | Cialone et al. | 400/126 X |

*Primary Examiner*—Paul T. Sewell

*Attorney, Agent, or Firm*—Frank C. Leach, Jr.; William J. Dick

[57] ABSTRACT

An interactive ink jet printer prints characters of a language from left to right or right to left in accordance with the direction in which the language is normally written. The signals for the direction in which a motor, which moves ink droplet supply device relative to a recording medium, the signals from a grating, which indicates the direction of motion of the ink droplet supply device and its position relative to a reference position, and the signals for the location of the ink droplet supply device at the reference position are changed whenever the direction of character printing is to be reversed.

27 Claims, 13 Drawing Figures

MULTILINGUAL INK JET PRINTER

In an interactive ink jet printer such as a typewriter having an ink jet head and a keyboard for use by a typist for printing to select characters, the ink jet head is mounted on a carrier for movement from left to right to print characters of the English language, for example, since this is the direction in which the English language is normally written. Thus, as the typist strikes each key to select a character, the ink jet head on the carrier moves relative to the recording medium, which is usually paper, so that a character is printed on the recording medium by selected ink droplets of an ink stream from the ink jet head striking the recording medium.

When the characters to be printed are in a language in which the characters are normally written from right to left such as the Farsi languages such as Hebrew and Arabic, for example, and the Urdu languages such as Pakistan and India, for example, the language cannot be produced by an interactive ink jet printer printing during movement of the ink jet head from left to right relative to the recording medium. With these languages, it is necessary to move the carrier having the ink jet head from right to left relative to the recording medium to print the characters.

The multilingual ink jet printer of the present invention enables characters to be printed from left to right or right to left depending on the language which is to be printed. Thus, a single ink jet printer can be employed to print characters irrespective of whether the language is normally written from left to right or right to left.

The ink jet printer of the present invention accomplishes this through providing an arrangement in which various signals utilized in printing characters from left to right are reversed when characters are to be printed from right to left. With the ink jet printer of the present invention, the selection of a language for printing in which printing is to occur from right to left automatically results in changing of all of the necessary signals. For example, the carrier is advanced from right to left during printing rather than from left to right.

Each of the languages, which the ink jet printer of the present invention can produce, may be stored as a different font in a manner such as that shown and described in U.S. Pat. No. 3,964,591 to Hill et al, which is incorporated by reference herein. While the aforesaid Hill et al patent does not disclose a font of a language written only from right to left, a font memory may store characters of a language to be written from right to left.

An object of this invention is to provide a multilingual ink jet printer capable of printing characters in the same direction as the language is normally written.

Another object of this invention is to provide an interactive ink jet printer in which characters are printed in the same direction as the language is normally written.

The foregoing and other objects, features, and advantages of the invention will be apparent from the following more particular description of the preferred embodiment of the invention, as illustrated in the accompanying drawings.

Figure 1:
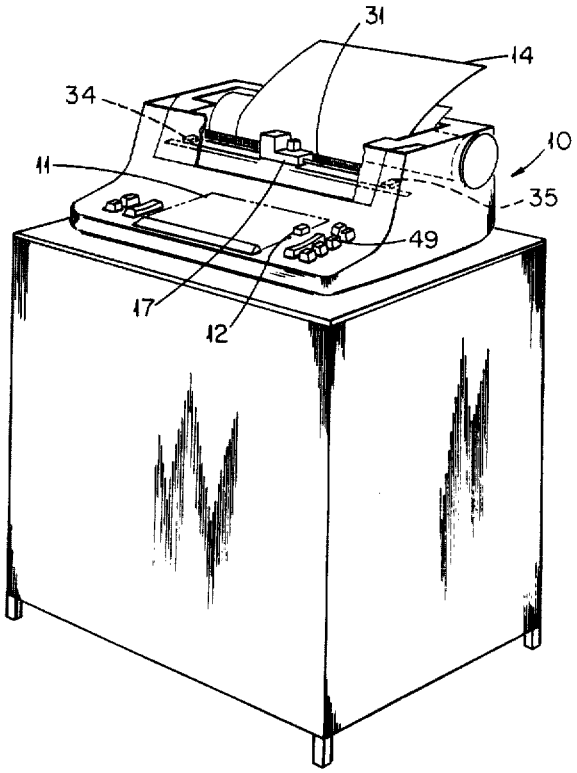
FIG. 1 is a schematic perspective view of an ink jet printer of the present invention.

Referring to the drawings and particularly FIG. 1, there is shown an ink jet printer 10 having a keyboard 11 so that the ink jet printer 10 is an interactive ink jet printer. The keyboard 11 has keys 12 to enable an operator to select characters for printing on a recording medium 14, which can be paper, for example, by ink droplets of a pressurized ink stream 15 (see FIG. 2) supplied from an ink nozzle 16 striking the recording medium 14 as indicated at 16'.

The ink jet nozzle 16, which may be a plurality of nozzles, if desired, is supported on a carrier 17, which is mounted for movement along a first axis. The first axis is substantially horizontal and substantially orthogonal to a second axis along which the recording medium 14 is moved relative to the carrier 17.

The ink stream 15 is supplied under pressure through the nozzle 16 from a drop generator 18. A crystal driver 19 (see FIG. 3) excites a piezoelectric crystal within the drop generator 18 (see FIG. 2) at a selected frequency to break up the ink stream 15 into droplets of substantially uniform size having substantially uniform spacing in the well-known manner such as shown and described in the copending patent application of W. L. Buehner et al for "Multiple Speed Ink Jet Printer," Ser. No. 960,417, filed Nov. 13, 1978, now U.S. Pat. No. 4,216,480, and assigned to the same assignee as the assignee of this application. The aforesaid Buehner et al application is incorporated herein by reference along with all of the other patent applications, patents, and publications referenced therein.

The individual droplets of the ink stream 15 pass through a charge electrode 20 and then between deflection electrodes 21 to strike the recording medium 14 at a desired location on the recording medium 14 so that each of the selected characters is formed by the ink droplets striking the recording medium 14.

Figure 2:
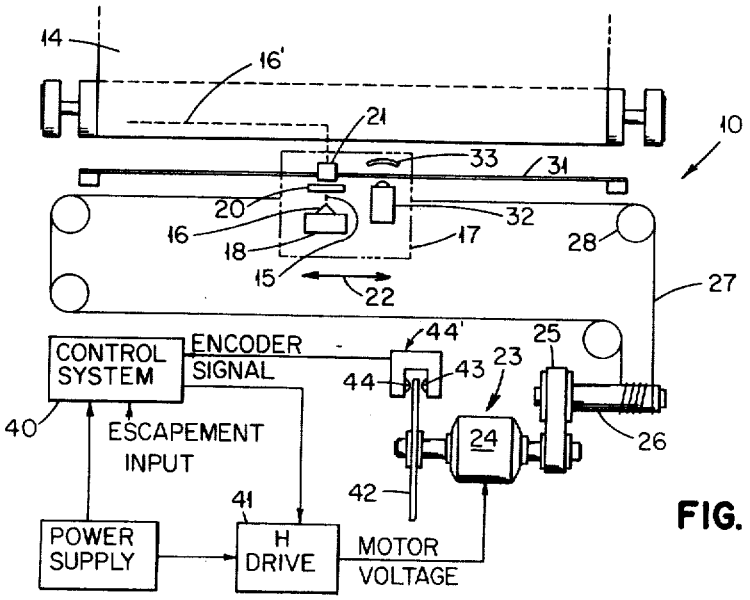
FIG. 2 is a schematic view of a portion of the printer of FIG. 1.

The carrier 17 is moved along the first axis in either direction, as indicated by an arrow 22 in FIG. 2, by reversible drive means 23. As shown and described in the copending patent application of D. B. Morgan et al for "Printer Escapement Control System," Ser. No. 954,374, filed Oct. 24, 1978 and assigned to the same assignee as the assignee of this application, the reversible drive means 23 includes a DC motor 24 connected by suitable means such as a timing belt 25, for example, to a cable wound drum 26. The aforesaid Morgan et al application is incorporated herein by reference along with all of the other patent applications, patents, and publications referenced therein.

The drum 26 has a plurality of turns of cable 27 thereon with opposite ends of the cable 27 connected to opposite sides of the carrier 17 after the cable 27 passes around a plurality of rollers 28. Thus, the direction of rotation of the DC motor 24 determines the direction of movement of the carrier 17 along the first axis relative to the recording medium 14.

It is necessary to always know the location of the carrier 17 relative to a fixed position as well as the direction of movement of the carrier 17 relative to the recording medium 14. Accordingly, the printer 10 has a grating system, which is more particularly shown and described in the copending patent application of D. R. Cialone et al for "Bi-Directional, Self Imaging Grating Detection Apparatus," Ser. No. 920,305, filed June 28, 1978, now U.S. Pat. No. 4,180,703. The aforesaid Cialone et al application is assigned to the same assignee as the assignee of this application. The aforesaid Cialone et al application is incorporated herein by reference along with all of the other patents and publications referenced therein.

Figure 3:
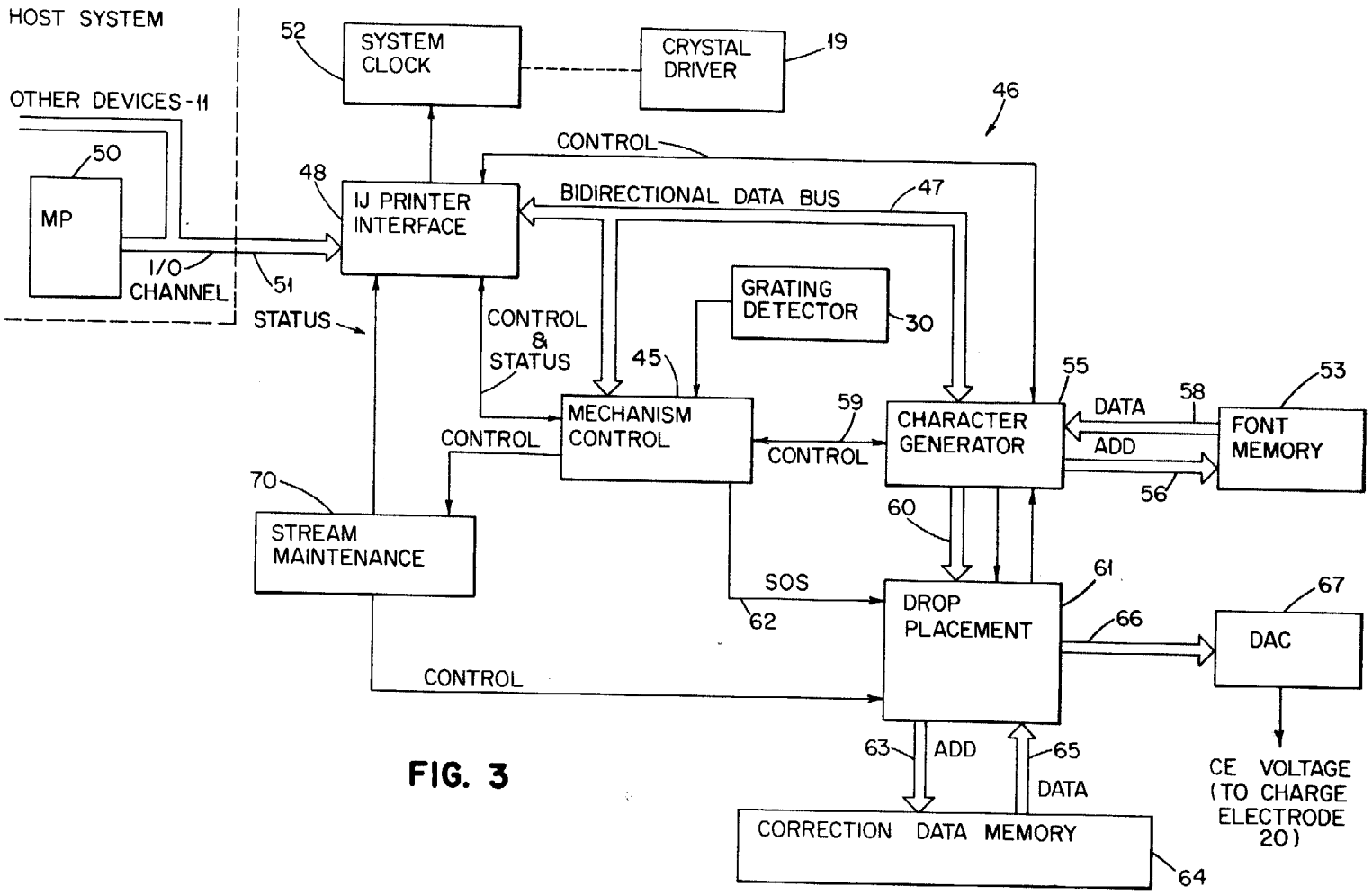
FIG. 3 is a block diagram of a portion of the electronic system of the ink jet printer of the present invention.

The grating system includes a grating detector 30 (see FIG. 3). The grating detector 30 has a grating 31 (see FIG. 2) employed in conjunction with a light emitting and detection module 32 and a mirror 33 to produce electrical signals GRAA (see FIGS. 9–12) and GRBB, which are 90° out of phase with each other, for utilization in indicating both the position of the carrier 17 relative to one of a left reed switch 34 (see FIG. 1) and a right reed switch 35 and the direction of movement of the carrier 17 relative to one of the left reed switch 34 and the right reed switch 35.

The left reed switch 34 is at a fixed location exterior of the leftmost printing margin of the printer 10 for printing characters on the recording medium 14. The right reed switch 35 is at a fixed location exterior of the rightmost printing margin of the printer 10 for printing characters on the recording medium 14. Each of the left reed switch 34 and the right reed switch 35 functions to indicate a specific location of the carrier 17 when the carrier 17 is engaged therewith.

As shown and described in the aforesaid Cialone et al application, the light emitting and detection module 33 includes a pair of detectors 36 (see FIG. 4) and 37. The detector 36 supplied its output signal to a channel A circuit 38, and the detector 37 supplies its output signal to a channel B circuit 39. The details of the channel A circuit 38 and the channel B circuit 39 are shown and described in the aforesaid Cialone et al application.

The output signal from the channel A circuit 38 is the GRAA signal and the output signal from the channel B circuit 39 is the GRBB signal. As shown in FIGS. 9–12, the GRAA and GRBB signals are 90° out of phase with each other with each of the GRAA and GRBB signals being a square wave. Thus, the relationship of the GRAA and GRBB signals is utilized to both indicate the position of the carrier 17 (see FIG. 1) with respect to one of the left reed switch 34 and the right reed switch 35 and the direction of motion of the carrier 17 relative to one of the left reed switch 34 and the right reed switch 35.

As previously mentioned, the carrier 17 is driven by the motor 24 (see FIG. 2) so that the carrier 17 moves along the first axis in either direction relative to the grating 31. The speed and the direction of rotation of the motor 24 are controlled by a control system 40, which is more particularly shown and described in the aforesaid Morgan et al application, through the control system 40 supplying signals to an H drive circuit 41, which is shown and described in the aforesaid Morgan et al application.

The motor 24 has its velocity (speed and direction of rotation) supplied to the control system 40 by an encoder signal. The motor 24 has an encoder wheel 42 mounted on a shaft of the motor 24 for rotation therewith.

The encoder wheel 42 has a plurality of equally angularly spaced slots adjacent its entire circumference to form a slotted circumferential portion, which passes between a light emitting diode or transistor 43 and a phototransistor and amplifier 44 of an encoder 44'. Thus, a pulse is emitted by the phototransistor 44 when the light of the light emitting diode or transistor 43 passes through one of the slots in the slotted portion of the wheel 42 and strikes the phototransistor 44.

The control system 40 is a portion of a mechanism control circuit 45 (see FIG. 3) of a system electronics 46, which is substantially the same as the printer electronics utilized in the IBM 6640 Document Printer, Model 1, as more particularly shown and described in the aforesaid Buehner et al application except for the mechanism control circuit 45. The mechanism control circuit 45 is connected through a bidirectional data bus 47 to an ink jet printer interface 48 as more particularly shown and described in the aforesaid Buehner et al application.

The various character selection keys 12 (see FIG. 1) of the keyboard 11 and function keys 49 of the keyboard 11 provide inputs to a microprocessor 50 (see FIG. 3). Thus, each of the character selection keys 12 (see FIG. 1) and each of the function keys 49 provide different signals to the microprocessor 50 (see FIG. 3). The microprocessor 50 and the character selection keys 12 (see FIG. 1) and the function keys 49 of the keyboard 11 or any other input device function as a host system to the system electronics 46 illustrated in block diagram form in FIG. 3.

The microprocessor 50 supplies an input to the ink jet printer interface 48 through an I/O channel 51 in accordance with the signal supplied from the keyboard 11 (see FIG. 1). As described in the aforesaid Buehner et al application, the I/O channel 51 (see FIG. 3) comprises eight data lines, four control lines, an interrupt line, and a master clock signal for a total of fourteen lines.

As discussed in the aforesaid Buehner et al application, the ink jet printer interface 48 provides, in a conventional manner, gating, logic, handshaking, suitable amplification, and an output from a master clock to a system clock 52 wherein frequency divider circuits divide the master clock frequency into various clock frequencies as more particularly shown and described in the aforesaid Buehner et al application. The system clock 52 also perturbs the crystal driver 19 at the desired frequency. The signals from the I/O channel 51 may be suitably amplified and buffered so as to receive serial instructions from the microprocessor 50.

The ink jet printer 10 (see FIG. 1) has a font memory 53 (see FIG. 3) in which are stored various font information holding memories with each of the font information holding memories containing the information for printing characters of a font of a specific language such as English, Hebrew, or Arabic, for example. The storing of various fonts in the font memory 53 is more particularly shown and described in the aforesaid Hill et al patent.

The font memory 53 has at least one font information holding memory containing font information requiring printing of characters by movement of the carrier 17 (see FIG. 2) relative to the recording medium 14 from left to right along the first axis such as the English language, for example. The font memory 53 (see FIG. 3) has at least one font information holding memory containing font information requiring printing of characters by movement of the carrier 17 from right to left such as Hebrew, for example. The font memory 53 (see FIG. 3) may contain any number of the font information holding memories with such being a read only storage (ROS) memory.

Each of the languages, which are stored in the different font information holding memories of the font memory 53, is selected by activation of at least one of the function keys 49 (see FIG. 1) of the keyboard 11 by the operator. It should be understood that activation of two of the function keys 49 might be required depending upon whether the font information holding memory, which is being selected, is a language to be written from left to right or right to left.

When one of the function keys 49 of the keyboard 11 of the printer 10 is activated to select one of the font information holding memories of the font memory 53 (see FIG. 3), the activation of the function key 49 (see FIG. 1) supplies a signal to the microprocessor 50 (see FIG. 3). This results in the microprocessor 50 supplying three eight bit bytes over the eight data lines of the I/O channel 51 to the ink jet printer interface 48.

As a result, the interface 48 supplies an eight bit signal over the bidirectional data bus 47 to a character generator 55. This signal is utilized to select one of the font information holding memories within the font memory 53 in the manner more particularly shown and described in the aforesaid Hill et al patent.

The character generator 55 supplies an address over an ADD bus 56 to the font memory 53 to select the font information holding memory in accordance with the activated function key 49 (see FIG. 1) of the keyboard 11 of the printer 10. Thereafter, activation of various of the character selection keys 12 of the keyboard 11 of the ink jet printer 10 results in print commands being supplied to the mechanism control circuit 45 (see FIG. 3) and the character generator 55 in the same manner as in the IBM 6640 Document Printer Model 1, as more particularly shown and described in the aforesaid Buehner et al application.

This includes supply of an address from the character generator 55 to the font memory 53 over the ADD bus 56 to select the character to be printed. The data extracted from the font memory 53 is supplied over a data bus 58 to the character generator 55 and is data for a single vertical scan of the printer 10 for the particular character to be printed as more particularly described in the aforesaid Buehner et al application.

When the scan information from the font memory 53 has been loaded into a shift register of the character generator 55 in the manner more particularly shown and described in the aforesaid Buehner et al application, the character generator 55 supplies a signal over a control bus 59 to the mechanism control circuit 45. This causes the mechanism control circuit 45 to put itself into a position ready to print, that is, at the print position.

With the character generator 55 having the scan information from the font memory 53 therein and the print signal having been supplied to the mechanism control circuit 45 across the control bus 59, the character generator 55 supplies a scan ready signal through a bus 60, which is a forty bit line, to a drop placement logic circuitry 61 as more particularly shown and described in the aforesaid Buehner et al application. The drop placement logic circuitry 61 receives a second signal from the mechanism control circuit 45 over a bus 62. This second signal is a start of scan (SOS) signal and is coincident with the carrier 17 (see FIG. 2) being disposed at a predetermined position along the first axis as determined by the grating detector 30 (see FIG. 3).

As more particularly shown and described in the aforesaid Buehner et al application, the IBM 6640 Document Printer, Model 1, has compensation for aerodynamic effects on the ink droplets as well as correction for induction effect of the previously printed and charged droplets so that each of the droplets, which are to be printed, will be applied to the recording medium 14 (see FIG. 1) at the desired position. The scheme employed in the IBM 6640 Document Printer, Model 1, is shown and described in U.S. Pat. No. 4,086,601 to Fillmore et al, which is incorporated herein by reference.

To provide for the compensation for both aerodynamic and induction effects, a shift register in the drop placement logic circuitry 61 (see FIG. 3) supplies an address over an ADD bus 63 to a correction data memory 64, which is a look-up table. The correction data memory 64 supplies the correct data signal for compensation over a data bus 64 to the drop placement logic circuitry 61.

The signal from the correction data memory 64 over the data bus 65 is supplied as an output signal from the drop placement logic circuitry 61 over a bus 66 to a digital to analog converter (DAC) 67. The DAC 67 supplies a charge electrode voltage to the charge electrode 20 (see FIG. 2). This results in each of the ink droplets of the stream 15 being selectively charged to a selected magnitude so that each of the droplets, which is to strike the recording medium 14, is directed to a desired position on the recording medium 14 to print the selected character in accordance with the scan information supplied from the font memory 53 (see FIG. 3) to the character generator 55.

As more particularly described in the aforesaid Buehner et al application, the mechanism control circuit 45 includes many different functions. One is the control and timing of a stream maintenance circuitry 70. The stream maintenance circuitry 70 monitors the ink stream 15 (see FIG. 2) at predetermined intervals to determine whether the deflected height of the droplet is within tolerances. The stream maintenance circuitry 70 (see FIG. 3) is more particularly shown and described in U.S. Pat. No. 4,136,435 to Neville et al. The aforesaid Neville et al patent is incorporated herein by reference.

The mechanism control circuit 45 also includes a common decoder for the sync and servo operations of the ink pump. One suitable example of the servo control of the ink pump is shown in U.S. Pat. No. 3,787,882 to Fillmore et al, which is incorporated herein by reference.

The mechanism control circuit 45 also includes a multilingual controlled logic circuit 71 (see FIG. 5) to which the GRAA and GRBB signals are supplied from the grating detector 30 (see FIG. 3). The GRAA signal is supplied from the channel A circuit 38 (see FIG. 4) as one input to an AND gate 72 (see FIG. 6) and as one input to an AND gate 73, and the GRBB signal is supplied from the channel B circuit 39 (see FIG. 4) as one input to an AND gate 74 (see FIG. 6) and as one input to an AND gate 75. The other input to the AND gate 72 and to the AND gate 75 is an LGMODE signal while the other input to each of the AND gates 73 and 74 is an LGMODE* signal. When the LGMODE signal is high, the LGMODE* signal is low and vice versa.

The LGMODE signal is supplied from a mechanical control logic circuit 76 (see FIG. 5) of the mechanism control circuit 45. The LGMODE signal is up when one of the function keys 49 (see FIG. 1) of the keyboard 11 is activated to select one of the font information holding memories in the font memory 53 (see FIG. 3) in which the characters are printed by movement of the carrier 17 (see FIG. 1) relative to the recording medium 14 in a left to right direction such as when writing the English language, for example. The LGMODE signal is low when one of the function keys 49 of the keyboard 11 of the ink jet printer 10 is activated to select one of the font information holding memories in the font memory 53 (see FIG. 3) in which the characters are printed by movement of the carrier 17 (see FIG. 1) from right to left relative to the recording medium 14 such as in the Hebrew language, for example. Thus, the high or low state of the LGMODE signal indicates the specific direction of movement of the carrier 17 in which printing of characters is to occur.

The multilingual controlled logic circuit 71 has an inverter to have the state of the LGMODE* signal opposite the state of the LGMODE signal. Accordingly, when the LGMODE signal is up and the LGMODE* signal is down, the output of the AND gate 72 (see FIG. 6) is a high GRAA1A signal when the GRAA signal is up and a low GRAA1A signal when the GRAA signal is down. The output of the AND gate 74 is a low GRAA1B signal during the entire time that the LGMODE signal is up because the LGMODE* signal is down.

Figure 9:
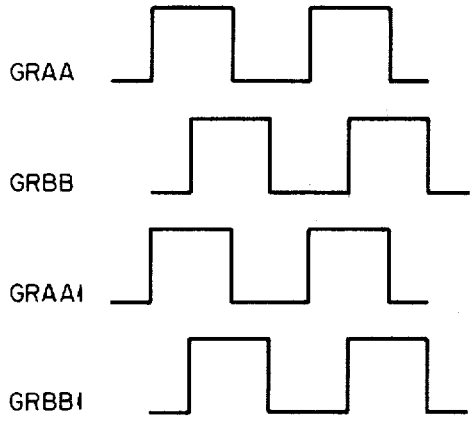
FIG. 9 is a diagram showing the relationship of output signals from the grating detector and the portion of the multilingual controlled logic circuit in FIG. 6 when characters are printed from left to right and the carrier is moving from left to right.

The outputs of the AND gates 72 and 74 are supplied as inputs to an EXCLUSIVE OR gate 78. Thus, the output of the EXCLUSIVE OR gate 78 is a high GRAA1 signal whenever its inputs are opposite. Therefore, with the LGMODE signal being high, the GRAA1 signal from the EXCLUSIVE OR gate 78 is the same as the GRAA signal so that the GRAA1 signal goes up and down to be a square wave like the GRAA signal as shown in FIG. 9.

When the LGMODE signal is high, both of the inputs to the AND gate 75 (see FIG. 6) are up when the GRBB signal goes up. Thus, when the LGMODE signal is up, the GRBB1A signal at the output of the AND gate 75 is the same as the GRBB signal so that it is a square wave.

With the LGMODE* signal being low, one of the inputs to the AND gate 73 is always low even though the GRAA signal, which is the other input to the AND gate 73, is changing state. Therefore, the output of the AND gate 73 has a low GRBB1B signal whenever the LGMODE signal is up.

The outputs of the AND gates 73 and 75 are supplied as inputs to an EXCLUSIVE OR gate 79. Therefore, the output of the EXCLUSIVE OR gate 79 is a GRBB1 signal, which is the same as the GRBB signal, when the LGMODE signal is up. Thus, the GRBB1 signal is a square wave signal in phase with the GRBB signal as shown in FIG. 9.

Figure 4:
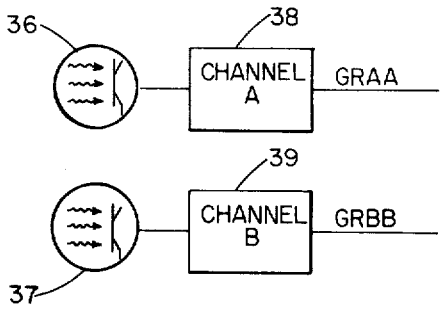
FIG. 4 is a block diagram of a portion of a grating detector of the ink jet printer of the present invention.
Figure 10:
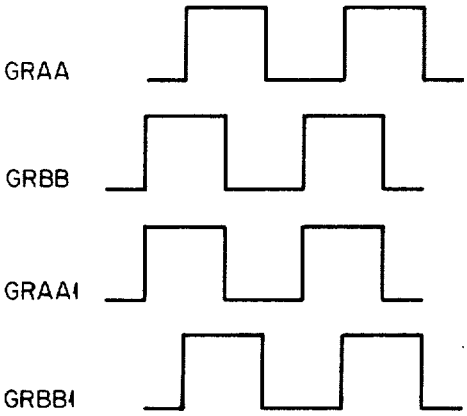
FIG. 10 is a diagram showing the relationship of output signals from the grating detector and the portion of the multilingual controlled logic circuit in FIG. 6 when characters are printed from right to left and the carrier is moving from right to left.

When the LGMODE signal is low and the LGMODE* signal is high so that the carrier 17 (see FIG. 1) moves from right to left relative to the recording medium 14 to print characters, the GRAA1B signal from the output of the AND gate 74 (see FIG. 6) is the same as the GRBB signal from the channel B circuit 39 (see FIG. 4). Thus, at this time, the GRAA1 signal from the output of the EXCLUSIVE OR gate 78 (see FIG. 6) is in phase with the GRBB signal, not the GRAA signal, as shown in FIG. 10.

Similarly, the GRBB1B signal from the output of the AND gate 73 (see FIG. 6) follows the GRAA signal when the LGMODE* signal is high. Thus, the GRBB1 signal from the output of the EXCLUSIVE OR gate 79 is in phase with the GRAA signal, as shown in FIG. 10, when there is to be printing of characters from right to left.

Therefore, the GRAA1 signal from the EXCLUSIVE OR gate 78 (see FIG. 6) always indicates the direction in which the carrier 17 (see FIG. 1) moves to produce printing of characters on the recording medium 14 while the GRBB1 signal from the output of the EXCLUSIVE OR gate 79 (see FIG. 6) always indicates the direction in which the carrier 17 (see FIG. 1) moves to return to start another line of print. The GRAA1 signal from the output of the EXCLUSIVE OR gate 78 (see FIG. 6) is supplied to a D input of a D-type flip flop 80. The GRBB1 signal from the output of the EXCLUSIVE OR gate 79 is supplied to a clock (C/K) input of the flip flop 80 and to a counter 81, which also receives an input from Q output of the flip flip 80. This connection arrangement of the flip flop 80 and the counter 81 is shown in the aforesaid Cialone et al application.

Thus, the state of the signal from the Q output of the flip flop 80 determines whether the counter 81 counts up or down each time that the GRBB1 signal supplied thereto from the EXCLUSIVE OR gate 79 goes high. The digital output of the counter 81 is utilized to indicate the position of the carrier 17 (see FIG. 1) relative to one of the left reed switch 34 and the right reed switch 35 depending on the direction in which characters are to be printed.

When the selected font information holding memory in the font memory 53 (see FIG. 3) requires printing of characters from left to right, the carrier 17 (see FIG. 1) is moved into engagement with the left reed switch 34 prior to the carrier 17 being positioned at a printing position. When the selected font information holding memory in the font memory 53 (see FIG. 3) requires printing of characters from right to left, then the carrier 17 (see FIG. 1) is moved into engagement with the right reed switch 35 prior to start of printing. It should be understood that the carrier 17 also is moved into engagement with the other of the left reed switch 34 and the right reed switch 35 prior to the carrier 17 being disposed at the printing position.

Figure 13:
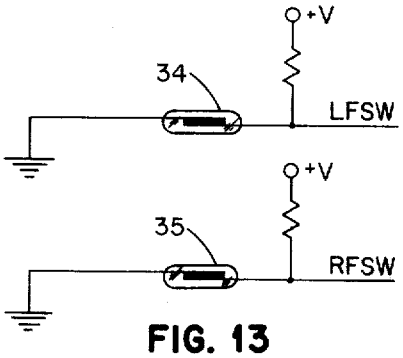
FIG. 13 is a block diagram of the reference switches.
Figure 5:
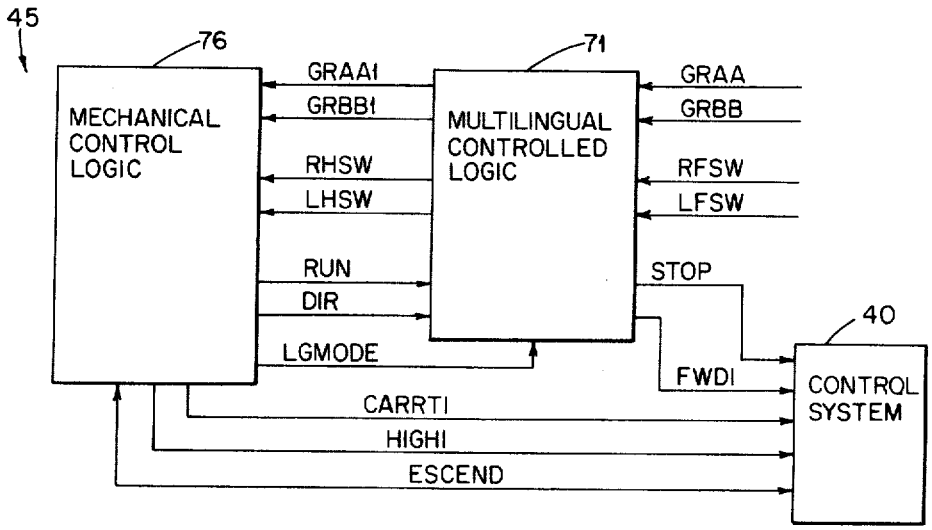
FIG. 5 is a block diagram of a portion of a mechanism control circuit of the electronic system of FIG. 3.

When the left reed switch 34 is engaed by the carrier 17, a high LFSW signal (see FIG. 13) is produced for supply to the multilingual controlled logic circuit 71 (see FIG. 5). When the carrier 17 (see FIG. 1) is moved into engagement with the right reed switch 35, a high RFSW signal (see FIG. 13) is produced and supplied to the multilingual controlled logic circuit 71 (see FIG. 5) of the mechanism control circuit 45.

The LFSW signal (see FIG. 13) is supplied as one input to an AND gate 85 (see FIG. 7), which has the LGMODE signal as its other input. The RFSW signal is supplied as one input to an AND gate 86, which has the LGMODE* signal as its other input Thus, when the LGMODE signal is high because characters are to be printed from left to right, the output of the AND gate 85 goes high when the LFSW signal is high because of the carrier 17 (see FIG. 1) having engaged the left reed switch 34. This produces a high LFSWA signal at the output of the AND gate 85 as one input to an EXCLUSIVE OR gate 87. At this time, the output of the AND gate 86 is always a low LFSWB signal because the LGMODE* signal is always low. Accordingly, the EXCLUSIVE OR gate 87 has a high LHSW signal at its output whenever the LFSW signal goes high with the LGMODE signal being high.

The LHSW signal from the EXCLUSIVE OR gate 87 is utilized to set the counter 81 (see FIG. 6) at a specific count. This enables the carrier 17 (see FIG. 1) to always have its location relative to the left reed switch 34 known through the count in the counter 81 (see FIG. 6) when the carrier 17 (see FIG. 1) is to print characters from left to right.

When characters are to be printed from right to left, the LGMODE signal is always low so that the LFSWA output signal from the AND gate 85 (see FIG. 7) is always low. However, the LGMODE* signal is high at all times during printing of characters from right to left. Accordingly, when the carrier 17 (see FIG. 1) is moved into engagement with the right reed switch 35, the RFSW signal goes high so that the LFSWB signal from the output of the AND gate 86 (see FIG. 7) is high. As a result, the LHSW signal at the output of the EXCLUSIVE OR gate 87 again is high. Since the high LHSW signal is utilized to set the count in the counter 81 (see FIG. 6) when the carrier 17 (see FIG. 1) engages the right reed switch 35 when printing is to occur from right to left, the count in the counter 81 (see FIG. 6) always indicates the position of the carrier 17 (see FIG. 1) with respect to the right reed switch 35 when printing is occurring from right to left.

Therefore, the count in the counter 81 (see FIG. 6) always indicates the position of the carrier 17 (see FIG. 1) with respect to a fixed reference position, either the left reed switch 34 or the right reed switch 35 depending upon the required direction of motion of the carrier 17 to print characters. Thus, the position of the carrier 17 is always ascertained with respect to the reference position exterior of the margin at which printing begins.

One state of the Q output of the flip flop 80 (see FIG. 6) indicates the direction of motion of the carrier 17 (see FIG. 1) in which printing of characters occurs irrespective of which direction printing occurs. That is, when the Q output of the flip flop 80 (see FIG. 6) is high, this indicates, for example, that the carrier 17 (see FIG. 1) is moving in the direction in which printing of characters occurs irrespective of whether that printing occurs due to motion of the carrier 17 from left to right or right to left. Likewise, the Q output of the flip flop 80 (see FIG. 6) is low when the carrier 17 (see FIG. 1) is moving in the direction in which there is no printing of characters irrespective of whether printing occurs by motion of the carrier 17 from left to right or right to left.

This is accomplished by the GRAA1 signal being supplied to the D input of the flip flop 80 (see FIG. 6) and the GRBB1 signal being supplied to the C/K input of the flip flop 80 at all times. As previously discussed, the GRAA1 signal is the GRAA signal when the carrier 17 is moving from left to right to print characters in this direction and is the GRBB signal when the carrier 17 is moving from right to left to print characters.

Therefore, as shown in FIGS. 9 and 10, when the square wave output of the GRAA1 signal is high and the GRBB1 signal goes high, the carrier 17 (see FIG. 1) is moving in the direction of printing of characters, irrespective of whether this is from left to right or right to left. This relation of the GRBB1 signal going up when the GRAA1 signal is high causes the Q output of the flip flop 80 to go high. This also causes the count in the counter 81 to be increased by one so that the count in the counter 81 always is increased in the direction in which printing occurs irrespective of whether characters are printed by movement of the carrier 17 from left to right or right to left.

When the GRAA1 signal is low at the D input of the flip flop 80 (see FIG. 6) at the time that the GRBB1 signal goes up, the Q output of the flip flop 80 is of the opposite state to that when the carrier 17 (see FIG. 1) is moving in the direction of printing of characters. Thus, this relationship indicates when the carrier 17 is returning in the reverse direction to that in which printing of characters occurs irrespective of whether printing occurs by motion of the carrier 17 from left to right or right to left.

Figure 11:
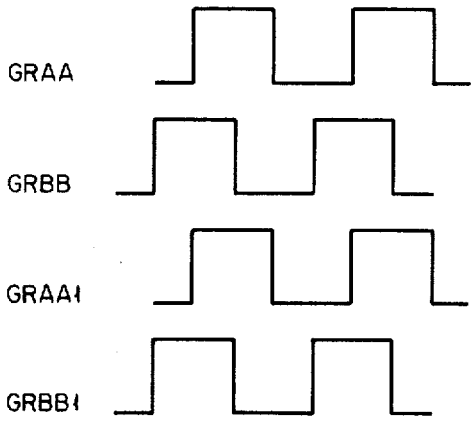
FIG. 11 is a diagram showing the relationship of output signals from the grating detector and the portion of the multilingual controlled logic circuit in FIG. 6 when characters are printed from left to right and the carrier is moving from right to left.

As shown in FIG. 11, the GRAA1 signal is low when the GRBB1 signal goes up when the carrier 17 (see FIG. 1) is moving from right to left with printing of characters occurring by movement of the carrier 17 from left to right. Therefore, this causes the Q output of the flip flop 80 (see FIG. 6) to be low.

Additionally, when the GRAA1 signal is low at the time that the GRBB1 signal goes high, the count in the counter 81 is reduced by the count of one. Thus, this decreases the count in the counter 81 as the carrier 17 (see FIG. 1) moves from right to left, which is the non-printing direction, at the time that printing of characters occurs by movement of the carrier 17 from left to right.

Figure 12:
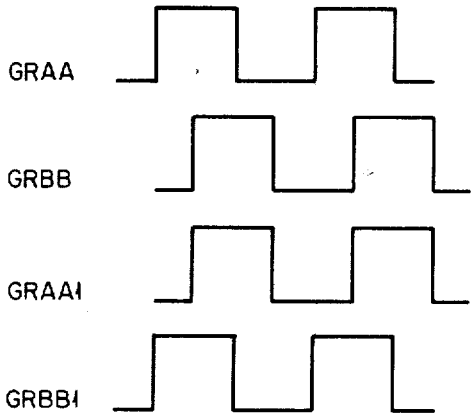
FIG. 12 is a diagram showing the relationship of output signals from the grating detector and the portion of the multilingual controlled logic circuit in FIG. 6 when characters are printed from right to left and the carrier is moving from left to right.

When characters are printed by movement of the carrier 17 from right to left, the GRAA1 signal is low when the GRBB1 signal goes high as shown in FIG. 12 during movement of the carrier 17 (see FIG. 1) from left to right. Thus, this causes the Q output of the flip flop 80 (see FIG. 6) to be low to indicate that the carrier 17 (see FIG. 1) is moving in the non-printing direction.

Furthermore, when the GRAA1 signal is low at the time that the GRBB1 signal goes high as shown in FIG. 12, the count in the counter 81 (see FIG. 6) is reduced by the count of one. Thus, this decreases the count in the counter 81 as the carrier 17 (see FIG.1) returns towards its position in which printing of another line starts.

Figure 6:
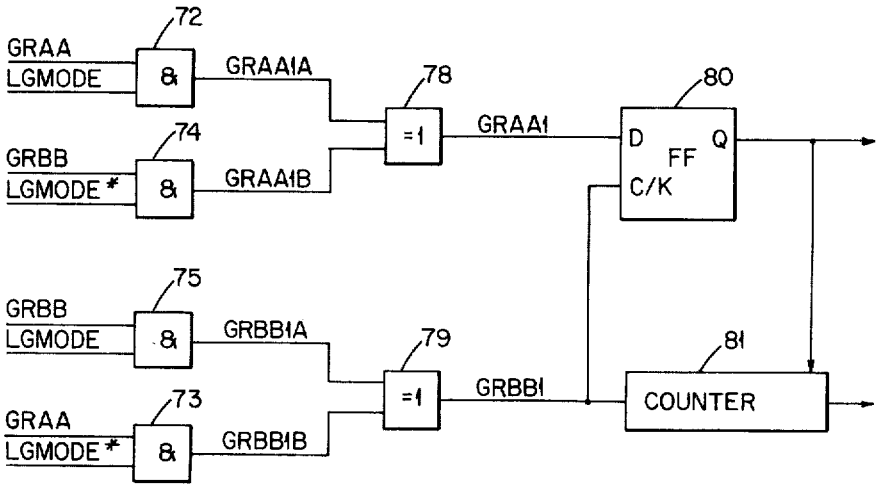
FIG. 6 is a block diagram of a portion of a multilingual controlled logic circuit of FIG. 5.

As previously mentioned, prior to start of printing, the carrier 17 also is moved into engagement with the other of the left reed switch 34 and the right reed switch 35 than that utilized to set the counter 81 (see FIG. 6). The signal produced from the other of the left reed switch 34 (see FIG. 1) and the right reed switch 35 being engaged by the carrier 17 is utilized for other functions such as to indicate when an error occurs or a servo cycle, for example.

Figure 7:
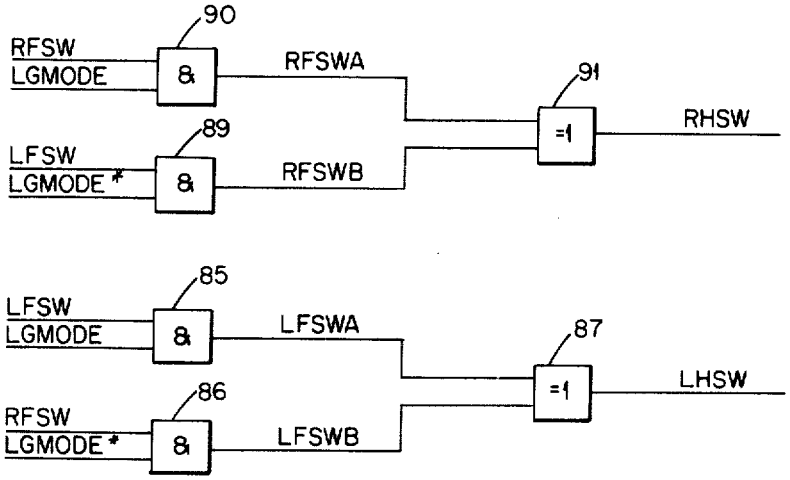
FIG. 7 is a block diagram of another portion of the multilingual controlled logic circuit of FIG. 5.

Accordingly, the LFSW signal, which goes high when the left reed switch 34 is engaged by the carrier 17, also is supplied as one input to an AND gate 89 (see FIG. 7). The other input to the AND gate 89 is the LGMODE* signal.

The RFSW signal, which goes high when the right reed switch 35 (see FIG. 1) is engaged by the carrier 17, is supplied as one input to an AND gate 90 (see FIG. 7). The other input to the AND gate 90 is the LGMODE signal.

Thus, when the LGMODE signal is high because characters are to be printed by movement of the carrier 17 (see FIG. 1) from left to right, the AND gate 90 (see FIG. 7) has a high RFSWA signal as its output when the RFSW signal is high. When the LGMODE* signal is high because printing of characters occurs from right to left, the AND gate 89 has a high RFSWB signal as its output when the LFSW signal goes high due to the carrier 17 (see FIG. 1) engaging the left reed switch 34.

The outputs of the AND gates 89 (see FIG. 7) and 90 are supplied as inputs to an EXCLUSIVE OR gate 91. Thus, when the carrier 17 (see FIG. 1) is printing characters by motion of the carrier 17 from left to right and the carrier 17 engages the right reed switch 35, the RFSWA signal will be high and the RFSWB signal will be low. This results in the EXCLUSIVE OR gate 91 (see FIG. 7) having a high RHSW signal as its output to indicate that the carrier 17 (see FIG. 1) is striking the right reed switch 35. The high RHSW signal is utilized for other functions such as a servo cycle, for example.

When characters are to be printed by the carrier 17 moving from right to left, the LGMODE* signal is up. Thus, the AND gate 90 (see FIG. 7) will not have a high RFSWA signal at its output because the LGMODE signal is low.

However, the AND gate 89 will have a high RFSWB signal at its output when the LFSW signal goes high due to the carrier 17 (see FIG. 1) engaging the left reed switch 34. Therefore, the RHSW signal at the output of the EXCLUSIVE OR gate 91 (see FIG. 7) goes up when the left reed switch 34 (see FIG. 1) is engaged by the carrier 17 at the time that the selected one of the font information holding memories in the font memory 53 (see FIG. 3) requires printing of characters by motion of the carrier 17 (see FIG. 1) from right to left. Again, the high RHSW signal is used for other functions such as a servo cycle, for example.

As previously mentioned, the speed and direction of rotation of the motor 24 (see FIG. 2) are controlled from a control system 40, which is a portion of the mechanism control circuit 45 (see FIG. 3). The control system 40 (see FIG. 2), as previously mentioned, is more particularly shown and described in the aforesaid Morgan et al application.

The mechanical control logic circuit 76 (see FIG. 5) of the mechanism control circuit 45 supplies CARRTI and HIGHI signals to the control system 40 in the same manner as described in the aforesaid Morgan et al application. The CARRTI and HIGHI signals determine the speed at which the motor 24 (see FIG. 2) rotates.

The mechanical control logic circuit 76 (see FIG. 5) also supplies a DIR signal in accordance with an input signal received by the ink jet printer interface 48 (see FIG. 3) from the microprocessor 50. When the DIR signal is high, the carrier 17 (see FIG. 1) is to move in the direction in which printing of characters is to occur. That is, when the DIR signal is high, the carrier 17 is to move from left to right when characters are to be printed from left to right and to move from right to left when characters are to be printed from right to left.

Figure 8:
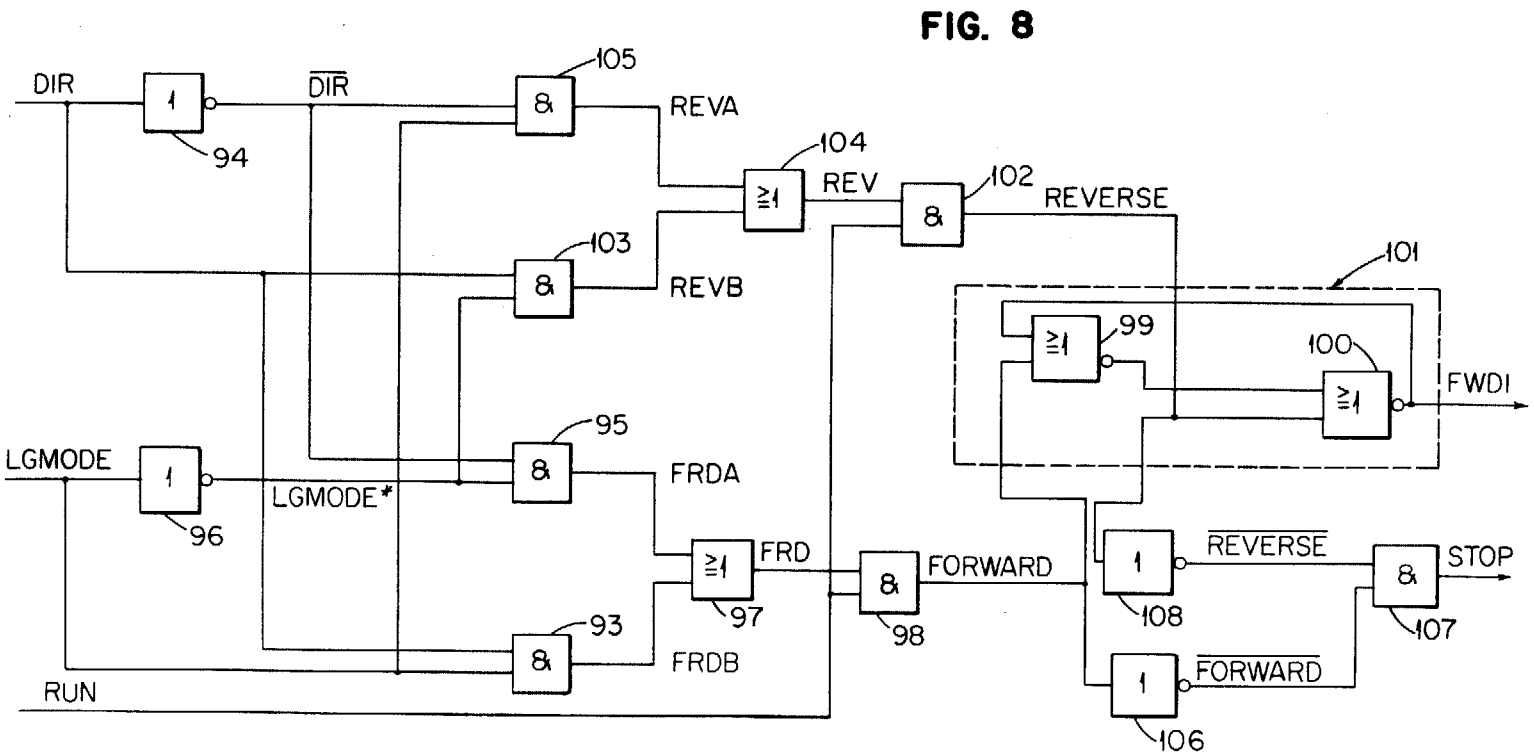
FIG. 8 is a block diagram of a further portion of the multilingual controlled logic circuit of FIG. 5.

The DIR signal is supplied to the multilingual controlled logic circuit 71 (see FIG. 5) from the mechanical control logic circuit 76. As shown in FIG. 8, the DIR signal is supplied as one of two inputs to an AND gate 93 while the other input to the AND gate 93 is the LGMODE signal. The DIR signal is inverted by an inverter 94 so that the output of the inverter 94 is a DIR signal, which is supplied as one input to an AND gate 95. The other input to the AND gate 95 is the LGMODE* signal. The LGMODE signal is inverted by an inverter 96 to produce the LGMODE* signal as the other input to the AND gate 95.

When the motor 24 (see FIG. 2) is to be rotated to advance the carrier 17 from left to right to print characters from left to right, both the DIR signal and the LGMODE signal are high. Thus, the AND gate 93 has a high FRDB signal as its output. The FRDB signal is supplied as one input to an OR gate 97 which has an FRD signal as its output. Therefore, the FRD signal is high when the FRDB signal is high.

The FRD signal from the OR gate 97 is supplied as one input to an AND gate 98, which has a RUN signal as its other input. The RUN signal is supplied from the mechanical control logic circuit 76 (see FIG. 5) of the mechanism control circuit 45 and is high whenever the motor 24 (see FIG. 2) is to rotate irrespective of the direction of rotation.

Thus, when the motor 24 is to rotate, the RUN signal is high. If the DIR signal is high to indicate movement of the carrier 17 in the direction in which printing of characters is to occur, the LGMODE signal is high to indicate that characters are to be printed by movement of the carrier 17 from left to right, and the RUN signal is high to indicate the motor 24 is to rotate, then the AND gate 98 (see FIG. 8) has a high FORWARD signal as its output.

The FORWARD signal is supplied as one input to a NOR gate 99, which along with a NOR gate 100 forms a latch 101. The output of the NOR gate 99 is supplied as one input to the NOR gate 100, which has its other input receiving a REVERSE signal from the output of an AND gate 102. The output of the NOR gate 100 is the other input to the NOR gate 99. The output of the NOR gate 100 produces a FWDI signal as the output of the latch 101.

Therefore, when the FORWARD signal from the output of the AND gate 98 is high because the carrier 17 (see FIG. 1) is to move from left to right, the FWDI signal from the latch 101 (see FIG. 8) is high. The FWDI signal from the latch 101 of the multilingual controlled logic circuit 71 (see FIG. 5) is supplied to the control system 40 to determine the direction in which the motor 24 (see FIG. 2) rotates. If the FWDI signal is high, the motor 24 rotates to move the carrier 17 from left to right whereas the carrier 17 is moved from right to left when the FWDI signal is low.

When the carrier 17 is to be moved from right to left to print characters, the LGMODE* signal is high as previously mentioned. If the DIR signal is low so that the DIR signal is high whereby no printing of characters is to occur during movement of the carrier 17, then both of the inputs to the AND gate 95 (see FIG. 8) are high so that an FRDA signal from the AND gate 95 is high. This results in the FRD signal from the OR gate 97 going high.

Accordingly, with the RUN signal being high, the AND gate 98 has a high FORWARD signal as its output. This again results in the FWDI signal from the latch 101 being high so that the carrier 17 (see FIG. 1) moves from left to right whereby this is the direction in which no printing occurs when the language is being written from right to left.

Thus, as previously mentioned, the high FWDI signal is utilized to always cause movement of the carrier 17 from left to right. This is when printing is to occur when the language is being written from left to right and this is when the carrier 17 is to return to start another line of printing when characters are being written from right to left.

The DIR signal also is supplied as one input to an AND gate 103 (see FIG. 8), which has the LGMODE* signal as its other input. Therefore, the LGMODE* signal and the DIR signals are high when the carrier 17 (see FIG. 1) is to be moved from right to left to print characters. The output of the AND gate 103 (see FIG. 8) has a REVB signal as its output, which is supplied as one input to an OR gate 104.

The OR gate 104 has a REV signal as its output, which is supplied as one input to the AND gate 102. The other input to the AND gate 102 is the RUN signal.

Accordingly, when the LGMODE* signal and the DIR signal are both high, the REV signal is high since the REVB signal from the AND gate 103 is high. Thus, with the RUN signal being high to indicate that the motor 24 (see FIG. 2) is to rotate, the AND gate 102 (see FIG. 8) has a high REVERSE signal as its output. At this time, the FORWARD signal from the AND gate 98 is low.

Accordingly, the high REVERSE signal from the AND gate 102 causes the output of the latch 101 to have a low FWDI signal. As a result, the carrier 17 (see FIG. 1) will be moved from right to left. This is what is desired when printing of characters from right to left is to occur as is indicated by the DIR and LGMODE* signals being high.

An AND gate 105 (see FIG. 8) has the $\overline{\text{DIR}}$ signal and the LGMODE signal as its two inputs. When both of these inputs are high, the AND gate 105 has a high REVA signal as its output. This is when there is to be movement of the carrier 17 (see FIG. 1) from right to left without printing; this occurs when printing characters from left to right as is indicated by the $\overline{\text{DIR}}$ and LGMODE signals being up.

The REVA signal from the output of the AND gate 105 (see FIG. 8) is supplied as an input to the OR gate 104. Therefore, when the REVA signal is high, the OR gate 104 has a high REV signal as its output.

With both the REV signal and the RUN signal being high, the AND gate 102 has a high REVERSE signal as its output. Again, this results in the latch 101 having a low FWDI signal, which causes movement of the carrier 17 (see FIG. 1) from right to left. Therefore, when characters are being printed from left to right so that the carrier 17 does not print during its return, the REVA signal from the AND gate 105 (see FIG. 8) is high to cause the FWDI signal from the output of the latch 101 to be low to cause rotation of the motor 24 (see FIG. 2) in the direction to drive the carrier 17 from right to left.

The FWDI signal from the latch 101 is utilized in the control system 40 (see FIG. 2) in the manner more particularly shown and described in the aforesaid Morgan et al application. The state of the FWDI signal results in the motor 24 being driven in the correct direction.

The FORWARD signal from the output of the AND gate 98 (see FIG. 8) also is supplied through an inverter 106 as one input to an AND gate 107. Thus, the inverter 106 supplies a $\overline{\text{FORWARD}}$ signal, which is the inverse of the FORWARD signal, as the input to the AND gate 107.

The REVERSE signal from the output of the AND gate 102 is supplied through an inverter 108 as the other input to the AND gate 107. Thus, the other input to the AND gate 107 is a $\overline{\text{REVERSE}}$ signal, which is the inverse of the REVERSE signal from the output of the AND gate 102.

Whenever the motor 24 (see FIG. 2) is not to rotate, the RUN signal from the mechanical control logic circuit 76 (see FIG. 5) of the mechanism control circuit 45 goes low. As a result, the outputs from the AND gates 98 (see FIG. 8) and 102 go low so that both the $\overline{\text{FORWARD}}$ signal and the $\overline{\text{REVERSE}}$ signal are high. This results in a high STOP signal at the output of the AND gate 107. The STOP signal is supplied to the control system 40 (see FIG. 2) and utilized in the manner more particularly shown and described in the aforesaid Morgan et al application to stop rotation of the motor 24.

Considering the operation of the ink jet printer 10 (see FIG. 1) of the present invention, the operator depresses at least one of the function keys 49 of the keyboard 11 of the ink jet printer 10 to select one of the font information holding memories within the font memory 53 (see FIG. 3). If the selected font information holding memory contains characters requiring printing by movement of the carrier 17 (see FIG. 1) from left to right, then the LGMODE signal from the mechanical control logic circuit 76 (see FIG. 5) of the mechanism control circuit 45 will be high. If the selected font information holding memory contains characters requiring printing from right to left, then the LGMODE signal from the mechanical control logic circuit 76 of the mechanism control circuit 45 will be low.

When the LGMODE signal is high, then the GRAA1 signal from the EXCLUSIVE OR gate 78 (see FIG. 6) is the same as the GRAA signal from the channel A circuit 38 (see FIG. 4) as shown in FIGS. 9 and 11 and the GRBB1 signal from the EXCLUSIVE OR gate 79 (see FIG. 6) is the same as the GRBB signal from the channel B circuit 39 (see FIG. 4) as shown in FIGS. 9 and 11. The counter 81 (see FIG. 6) will be initialized when the LHSW signal from the EXCLUSIVE OR gate 87 (see FIG. 7) goes high due to the left reed switch 34 (see FIG. 1) being engaged by the carrier 17, and the location of the carrier 17, in accordance with the count in the counter 81 (see FIG. 6), will be with respect to the left reed switch 34 (see FIG. 1).

With the LGMODE signal being high, the FWDI signal from the multilingual controlled logic circuit 71 (see FIG. 5) will be high when the DIR signal is high and will be low when the $\overline{\text{DIR}}$ signal is high. Thus, the carrier 17 (see FIG. 1) advances from left to right when the DIR signal is high whereby printing of characters occurs as the carrier 17 moves from left to right.

If the LGMODE signal from the mechanical control logic circuit 76 (see FIG. 5) of the mechanism control circuit 45 is low so that printing of characters is to occur from right to left, then the GRAA1 signal from the EXCLUSIVE OR gate 78 (see FIG. 6) will be the GRBB signal from the channel B circuit 39 (see FIG. 4)

as shown in FIGS. 10 and 12 and the GRBB1 signal from the EXCLUSIVE OR gate 79 (see FIG. 6) will be the GRAA signal from the channel A circuit 38 (see FIG. 4) as shown in FIGS. 10 and 12. With this arrangement, the LHSW signal from the EXCLUSIVE OR gate 87 (see FIG. 7) to initialize the counter 81 (see FIG. 6) will be produced from the RFSW signal going high due to the right reed switch 35 (see FIG. 1) being engaged by the carrier 17 prior to starting of printing. The location of the carrier 17, in accordance with the count in the counter 81 (see FIG. 6), will be with respect to the right reed switch 34 (see FIG. 1).

With the LGMODE signal low so that the LGMODE* signal is high, the FWDI signal from the latch 101 (see FIG. 8) of the multilingual controlled logic circuit 71 (see FIG. 5) is low when the DIR signal is high. This causes the carrier 17 (see FIG. 1) to be moved from right to left, and this is the direction in which printing of characters occurs when the LGMODE* signal is high. When the $\overline{\text{DIR}}$ signal goes high to have the carrier 17 (see FIG. 1) return to start another line of printing from right to left, the FWDI signal from the latch 101 (see FIG. 8) goes high to cause the carrier 17 to move from left to right. This is the return direction of the carrier 17 when printing characters from right to left.

While the present invention has shown and described the motor 24 (see FIG. 2) as being controlled through the control system 40, it should be understood that any other arrangement for controlling the motor 24 could be employed. Thus, the outputs of the AND gates 98 (see FIG. 8) and 102, for example, could be utilized with a different system for controlling the motor 24 to cause rotation of the motor 24 (see FIG. 2) in the desired direction. However, the control system 40 is the preferred embodiment for rotating the motor 24.

While the carrier 17 has been shown and described as moving relative to the recording medium 14 in either direction along the first axis, it should be understood that the carrier 17 could be stationary and the recording medium 14 be moved if desired. It is only necessary that there be relative movement between the carrier 17 and the recording medium 14 in both directions along the first axis.

While the present invention has shown and described the recording medium 14 as being movable relative to the carrier 17 along the second axis, which is substantially orthogonal to the first axis, it should be understood that the recording medium 14 could be supported on a flat surface, for example, and the carrier 17 moved relative to the recording medium 14 along the second axis. Thus, it is only necessary that there be relative movement of one of the recording medium 14 and the carrier 17 with respect to the other along the second axis.

An advantage of this invention is that it enables the typist to see formation of the characters in the direction in which the language is normally written. Another advantage of this invention is that a single ink jet printer can be employed for languages requiring printing of characters in either the left to right direction or the right to left direction whereby the cost of producing printers is reduced.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. An ink jet printer including:

a recording medium;

supply means to supply ink droplets to said recording medium to cause printing of droplets thereon as characters;

first reference means and second reference means spaced from each other along a first axis;

one of said recording medium and said supply means having movement relative to the other along the first axis in either direction;

one of said recording medium and said supply means having relative movement with respect to the other along a second axis at an angle to the first axis;

determining means to determine the position of the movable one of said recording medium and said supply means with respect to one of said first reference means and said second reference means at any time and to determine the direction of motion of the movable one of said recording medium and said supply means along the first axis with respect to one of said first reference means and said second reference means;

a plurality of font information holding memories;

at least one of said font information holding memories containing font information requiring printing of characters by movement of the movable one of said recording medium and said supply means in one direction along the first axis;

at least one of said font information holding memories containing font information requiring printing of characters by movement of the movable one of said recording medium and said supply means in the reverse direction to the one direction along the first axis;

selection means to select one of said font information holding memories for character printing;

and means responsive to said selection means to cause said determining means to determine the position and direction of motion of the movable one of said recording medium and said supply means with respect to one of said first reference means and said second reference means when said selection means selects one of said font information holding memories requiring printing of characters in the one direction along the first axis and with respect to the other of said first reference means and said second reference means when said selection means selects one of said font information holding memories requiring printing of characters in the reverse direction along the first axis.

2. The ink jet printer according to claim 1 including moving means to reciprocate said supply means along the first axis to produce movement of said supply means relative to said recording medium along the first axis.

3. The ink jet printer according to claim 2 in which:

said printer is an interactive printer;

and said selection means includes means manually activated by a user.

4. The ink jet printer according to claim 3 in which:

said determining means produces a first detecting signal and a second detecting signal out of phase with the first detecting signal so that one of the first detecting signal and the second detecting signal leads the other as said supply means moves relative to said recording medium;

said responsive means includes first control means to control the phase relation of the first detecting signal and the second detecting signal in accordance with whether the selected one of said font information holding memories requires printing of characters by movement of said supply means in the one direction or the reverse direction so that the first detecting signal always leads the second detecting signal during printing of characters irrespective of the direction of movement of said supply means and the second detecting signal always leads the first detecting signal during movement of said supply means in the opposite direction to that in which printing occurs irrespective of the direction of movement of said supply means;

and said determining means includes direction determining means to determine which of the first detecting signal and the second detecting signal is leading the other to determine the direction of motion of said supply means with respect to one of said first reference means and said second reference means when the selected one of said font information holding memories requires printing of characters by movement of said supply means in the one direction and with respect to the other of said first reference means and said second reference means when the selected one of said font information holding memories requires printing of characters by movement of said supply means in the reverse direction.

5. The ink jet printer according to claim 4 in which:

said determining means includes position determining means to determine the position of said supply means with respect to one of said first reference means and said second reference means;

and said responsive means includes second control means to control which of said first reference means and said second reference means is used with said position determining means in accordance with whether the selected one of said font information holding memories requires printing of characters by movement of said supply means in the one direction or the reverse direction.

6. The ink jet printer according to claim 5 in which:

said position determining means includes counting means;

and said second control means of said responsive means includes means to set said counting means at a selected count when one of said first reference means and said second reference means is engaged by said supply means prior to starting of printing in accordance with the selected one of said font information holding memories requiring print of characters by movement of said supply means relative to said recording medium in the one direction and at a selected count when the other of said first reference means and said second reference means is engaged by said supply means prior to starting of printing in accordance with the selected one of said font information holding memories requiring printing of characters by movement of said supply means relative to said recording medium in the reverse direction.

7. The ink jet printer according to claim 3 including:

means to produce a first signal when printing of characters is to occur by movement of said supply means relative to said recording medium irrespective of the direction in which the selected one of said font information holding memories requires printing of characters and a second signal when said supply means is to be returned to start another line of print irrespective of the direction in which the selected one of said font information holding memories requires printing of characters;

and said responsive means includes first control means to control the first signal and the second signal to cause said moving means to move said supply means in the one direction in response to the first signal and in the reverse direction in response to the second signal when the selected one of said font information holding memories requires printing of characters to occur by movement of said supply means in the one direction and to cause said moving means to move said supply means in the reverse direction in response to the first signal and in the one direction in response to the second signal when the selected one of said font information holding memories requires printing of characters to occur by movement of said supply means in the reverse direction.

8. The ink jet printer according to claim 3 in which said moving means includes reversible drive means.

9. The ink jet printer according to claim 8 in which:

said determining means includes position determining means to determine the position of said supply means with respect to one of said first reference means and said second reference means;

and said responsive means includes second control means to control which of said first reference means and said second reference means is used with said position determining means in accordance with whether the selected one of said font information holding memories requires printing of characters by movement of said supply means in the one direction or the reverse direction.

10. The ink jet printer according to claim 9 in which:

said position determining means includes counting means;

and said second control means of said responsive means includes means to set said counting means at a selected count when one of said first reference means and said second reference means is engaged by said supply means prior to starting of printing in accordance with the selected one of said font information holding memories requiring printing of characters by movement of said supply means relative to said recording medium in the one direction and at a selected count when the other of said first reference means and said second reference means is engaged by said supply means prior to starting of printing in accordance with the selected one of said font information holding memories requiring printing of characters by movement of said supply means relative to said recording medium in the reverse direction.

11. The ink jet printer according to claim 3 in which said responsive means includes means to control the direction of movement of said supply means by said moving means during printing of characters in accordance with whether said selection means selects one of said font information holding memories requiring printing of characters in the one direction or the reverse direction.

12. The ink jet printer according to claim 2 in which said responsive means includes means to control the direction of movement of said supply means by said moving means during printing of characters in accordance with whether said selection means selects one of said font information holding memories requiring printing of characters in the one direction or the reverse direction.

13. The ink jet printer according to claim 1 including moving means to reciprocate the movable one of said supply means and said recording medium along the first axis to produce movement of one of said supply means and said recording medium relative to the other along the first axis.

14. The ink jet printer according to claim 13 in which:

said printer is an interactive printer;

and said selection means includes means manually activated by a user.

15. The ink jet printer according to claim 14 in which:

said determining means produces a first detecting signal and a second detecting signal out of phase with the first detecting signal so that one of the first detecting signal and the second detecting signal leads the other as the movable one of said supply means and said recording medium moves;

said responsive means includes first control means to control the phase relation of the first detecting signal and the second detecting signal in accordance with whether the selected one of said font information holding memories requires printing of characters by movement of the movable one of said supply means and said recording medium in the one direction or the reverse direction so that the first detecting signal always leads the second detecting signal during printing of characters irrespective of the direction of movement of the movable one of said supply means and said recording medium and the second detecting signal always leads the first detecting signal during movement of the movable one of said supply means and said recording medium in the opposite direction to that in which printing occurs irrespective of the direction of movement of the movable one of said supply means and said recording medium;

and said determining means includes direction determining means to determine which of the first detecting signal and the second detecting signal is leading the other to determine the direction of motion of the movable one of said supply means and said recording medium with respect to one of said first reference means and said second reference means when the selected one of said font information holding memories requires printing of characters by movement of the movable one of said supply means and said recording medium in the one direction and with respect to the other of said first reference means and said second reference means when the selected one of said font information holding memories requires printing of characters by movement of the movable one of said supply means and said recording medium in the reverse direction.

16. The ink jet printer according to claim 15 in which:

said determining means includes position determining means to determine the position of the movable one of said supply means and said recording medium with respect to one of said first reference means and said second reference means;

and said responsive means includes second control means to control which of said first reference means and said second reference means is used with said position determining means in accordance with whether the selected one of said font information holding memories requires printing of characters by movement of the movable one of said supply means and said recording medium in the one direction or the reverse direction.

17. The ink jet printer according to claim 16 in which:

said position detecting means includes counting means;

and said second control means of said responsive means includes means to set said counting means at a selected count when one of said first reference means and said second reference means is engaged by the movable one of said supply means and said recording medium prior to starting of printing in accordance with the selected one of said font information holding memories requiring printing of characters by movement of the movable one of said supply means and said recording medium in the one direction and at a selected count when the other of said first reference means and said second reference means is engaged by the movable one of said supply means and said recording medium prior to starting of printing in accordance with the selected one of said font information holding memories requiring printing of characters by movement of the movable one of said supply means and said recording medium in the reverse direction.

18. The ink jet printer according to claim 14 including:

means to produce a first signal when printing of characters is to occur by movement of the movable one of said supply means and said recording medium irrespective of the direction in which the selected one of said font information holding memories requires printing of characters and a second signal when the movable one of said supply means and said recording medium is to be returned to start another line of print irrespective of the direction in which the selected one of said font information holding memories requires printing of characters;

and said responsive means including means to control the first signal and the second signal to cause said moving means to move the movable one of said supply means and said recording medium in the one direction in response to the first signal and in the reverse direction in response to the second signal when the selected one of said font information holding memories requires printing of characters to occur by movement of the movable one of said supply means and said recording medium in the one direction and to cause said moving means to move the movable one of said supply means and said recording medium in the reverse direction in response to the first signal and in the one direction in response to the second signal when the selected one of said font information holding memories requires printing of characters to occur by movement of the movable one of said supply means and said recording medium in the reverse direction.

19. The ink jet printer according to claim 14 in which said responsive means includes means to control the direction of movement of the movable one of said supply means and said recording medium by said moving means during printing of characters in accordance with whether said selection means selects one of said font information holding memories requiring printing of characters in the one direction or the reverse direction.

20. The ink jet printer according to claim 13 in which said responsive means includes means to control the direction of movement of the movable one of said supply means and said recording medium by said moving means during printing of characters in accordance with whether said selection means selects one of said font information holding memories requiring printing of characters in the one direction or the reverse direction.

21. The ink jet printer according to claim 13 including:

means to produce a first signal when printing of characters is to occur by movement of the movable one of said supply means and said recording medium irrespective of the direction in which the selected one of said font information holding memories requires printing of characters and a second signal when the movable one of said supply means and said recording medium is to be returned to start another line of print irrespective of the direction in which the selected one of said font information holding memories requires printing of characters;

and said responsive means including means to control the first signal and the second signal to cause said moving means to move the movable one of said supply means and said recording medium in the one direction in response to the first signal and in the reverse direction in response to the second signal when the selected one of said font information holding memories requires printing of characters to occur by movement of the movable one of said supply means and said recording medium in the one direction and to cause said moving means to move the movable one of said supply means and said recording medium in the reverse direction in response to the first signal and in the one direction in response to the second signal when the selected one of said font information holding memories requires printing of characters to occur by movement of the movable one of said supply means and said recording medium in the reverse direction.

22. The ink jet printer according to claim 1 in which:

said determining means produces a first detecting signal and a second detecting signal out of phase with the first detecting signal so that the one of the first detecting signal and the second detecting signal leads the other as the movable one of said supply means and said recording medium moves;

said responsive means includes first control means to control the phase relation of the first detecting signal and the second detecting signal in accordance with whether the selected one of said font information holding memories requires printing of characters by movement of the movable one of said supply means and said recording medium in the one direction or the reverse direction so that the first detecting signal always leads the second detecting signal during printing of characters irrespective of the direction of movement of the movable one of said supply means and said recording medium and the second detecting signal always leads the first detecting signal during movement of the movable one of said supply means and said recording medium in the opposite direction to that in which printing occurs irrespective of the direction of movement of the movable one of said supply means and said recording medium;

and said determining means includes direction determining means to determine which of the first control signal and the second control signal is leading the other to determine the direction of motion of the movable one of said supply means and said recording medium with respect to one of said first reference means and said second reference means when the selected one of said font information holding memories requires printing of characters by movement of the movable one of said supply means and said recording medium in the one direction and with respect to the other of said first reference means and said second reference means when the selected one of said font information holding memories requires printing of characters by movement of the movable one of said supply means and said recording medium in the reverse direction.

23. The ink jet printer according to claim 22 in which:

said detecting means includes position determining means to determine the position of the movable one of said supply means and said recording medium with respect to one of said first reference means and said second reference means;

and said responsive means includes second control means to control which of said first reference means and said second reference means is used with said position determining means in accordance with whether the selected one of said font information holding memories requires printing of characters by movement of the movable one of said supply means and said recording medium in the one direction or the reverse direction.

24. The ink jet printer according to claim 23 in which:

said position determining means includes counting means;

and said second control means of said responsive means includes means to set said counting means at a selected count when one of said first reference means and said second reference means is engaged by the movable one of said supply means and said recording medium prior to starting of printing in accordance with the selected one of said font information holding memories requiring printing of characters by movement of the movable one of said supply means and said recording medium in the one direction and at a selected count when the other of said first reference means and said second reference means is engaged by said supply means prior to starting of printing in accordance with the selected one of said font information holding memories requiring printing of characters by movement of the movable one of said supply means and said recording medium in the reverse direction.

25. The ink jet printer according to claim 1 in which:

said printer is an interactive printer;

and said selection means includes means manually activated by a user.

26. The ink jet printer according to claim 25 in which said responsive means includes means to control the direction of movement of the movable one of said supply means and said recording medium during printing of characters in accordance with whether said selection means selects one of said font information holding memories requiring printing of characters in the one direction or the reverse direction.

27. The ink jet printer according to claim 1 in which said responsive means includes means to control the direction of movement of the movable one of said supply means and said recording medium during printing of characters in accordance with whether said selection means selects one of said font information holding memories requiring printing of characters in the one direction or the reverse direction.

* * * * *